US009441417B2

(12) United States Patent
Shih et al.

(10) Patent No.: US 9,441,417 B2
(45) Date of Patent: Sep. 13, 2016

(54) PULL ROPE FREE CURTAIN STRUCTURE

(71) Applicant: TAIWAN BAMBOO CURTAIN ENTERPRISE CO., LTD., Changhua Hsien (TW)

(72) Inventors: Chin-Chang Shih, Changhua Hsien (TW); Yang-Hsin Shih, Changhua Hsien (TW)

(73) Assignee: TAIWAN BAMBOO CURTAIN ENTERPRISE CO., LTD., Chang Hua Hsien (TW)

( * ) Notice: Subject to any disclaimer, the term of this patent is extended or adjusted under 35 U.S.C. 154(b) by 0 days.

(21) Appl. No.: 14/590,174

(22) Filed: Jan. 6, 2015

(65) Prior Publication Data

US 2015/0211294 A1 Jul. 30, 2015

(30) Foreign Application Priority Data

Jan. 24, 2014 (TW) ..... 103201623 U

(51) Int. Cl.
*E06B 9/262* (2006.01)
*E06B 9/322* (2006.01)

(52) U.S. Cl.
CPC ..... *E06B 9/322* (2013.01); *E06B 9/262* (2013.01); *E06B 2009/2625* (2013.01); *E06B 2009/3222* (2013.01)

(58) Field of Classification Search
CPC ..... E06B 2009/3222; E06B 2009/2625; E06B 2009/2627; E06B 2009/3225
USPC ..... 160/84.03, 84.04, 84.06, 170
See application file for complete search history.

(56) References Cited

U.S. PATENT DOCUMENTS 4,733,711 A * 3/1988 Schon ..... E06B 9/262 160/279
4,953,610 A * 9/1990 Phillips ..... E06B 9/262 160/115
5,477,904 A * 12/1995 Yang ..... B60J 1/2091 160/370.23
6,644,373 B2 * 11/2003 Palmer ..... E06B 9/322 160/168.1 R
6,991,020 B1 * 1/2006 Cheng ..... E06B 9/262 160/168.1 R
7,143,802 B2 * 12/2006 Strand ..... E06B 9/262 160/167 R
7,398,815 B2 * 7/2008 Liang ..... E06B 9/262 160/170
7,487,817 B2 * 2/2009 Liang ..... E06B 9/32 160/170
7,950,437 B2 * 5/2011 Lin ..... E06B 9/322 160/168.1 R
2007/0119547 A1 * 5/2007 Liang ..... E06B 9/32 160/170
2007/0272364 A1 * 11/2007 Liang ..... E06B 9/322 160/84.05
2008/0289774 A1 * 11/2008 Ying ..... E06B 9/323 160/178.1 R
2013/0255891 A1 * 10/2013 Shih ..... E06B 9/262 160/168.1 R

* cited by examiner

*Primary Examiner* — David Purol

(57) ABSTRACT

A pull rope free curtain structure contains: a hollow first rod, a second rod, a body including a bottom end mounted on the second rod, and at least one elastic rope assembly. Each elastic rope assembly includes: two driving members accommodated in the first rod; a first control rope winded between the two driving members, and two ends of the first control rope of one of the at least one elastic rope assembly being intersected and inserted through the first rod and being fixed on the second rod via the body; a second control rope winded on two ends of the first rod, the second control rope having two ends fixed on one of the two driving members; a positioning member fitted on a central position of the first rod and retained on a central position of the second control rope.

17 Claims, 15 Drawing Sheets

PULL ROPE FREE CURTAIN STRUCTURE

FIELD OF THE INVENTION

The present invention relates to furniture, and more particularly to a pull rope free curtain structure.

BACKGROUND OF THE INVENTION

A conventional pull rope free curtain structure contains a first rod having an accommodating cavity and plural orifices defined on a bottom end of the accommodating cavity, wherein a rolling controller and a holder are mounted on two sides of the accommodating cavity, and a movable seat is defined between the rolling controller and the holder to freely slide in the accommodating cavity. The first rod has a body and a second rod which are fixed on a bottom end of the first rod, and a control rope is connected with the body and the second rod and is inserted through the plural orifices of the first rod, the holder and the movable seat have a plurality of guiding sliders for guiding the control rope. The rolling controller has a drive rope, and the drive rope has a retaining block disposed on one end thereof, the movable seat has a positioning block with a recess for retaining with the retaining block, such that the drive rope drives the control rope so that the second rod is manually pushed or pulled to release or pull the control rope on the movable seat and to drive the drive rope, thus expanding or retracting the body easily.

However, as expanding or retracting the body, the body cannot maintain at a balance state, hence the body is tilted, the control rope is unbalanced to make the driving member unstable. In other words, the driving member is stuck in the first rod or removes from the first rod. In addition, two ends of the control rope are winded together to expand or retract the body poorly.

The present invention has arisen to mitigate and/or obviate the afore-described disadvantages.

SUMMARY OF THE INVENTION

The primary objective of the present invention is to provide a pull rope free curtain structure which expands and retracts stably and smoothly.

To obtain the above objective, a pull rope free curtain structure provided by the present invention contains: a first rod, a second rod, a body, at least one elastic rope assembly, and two driving members.

The first rod is hollow.

The second rod is parallel to the first rod.

The body includes a bottom end mounted on the second rod.

Each elastic rope assembly includes:

two driving members, each being accommodated in the first rod;

a first control rope winded between the two driving members, and two ends of the first control rope of one of the at least one elastic rope assembly being intersected and inserted through two inner bottoms of the first rod and then being fixed on two ends of the second rod via the body;

a second control rope being elastic and being winded on two ends of the first rod, the second control rope having two ends fixed on one of the two driving members; and a positioning member fitted on a central position of the first rod and retained on a central position of the second control rope.

DETAILED DESCRIPTION OF THE PREFERRED EMBODIMENTS

Figure 1:
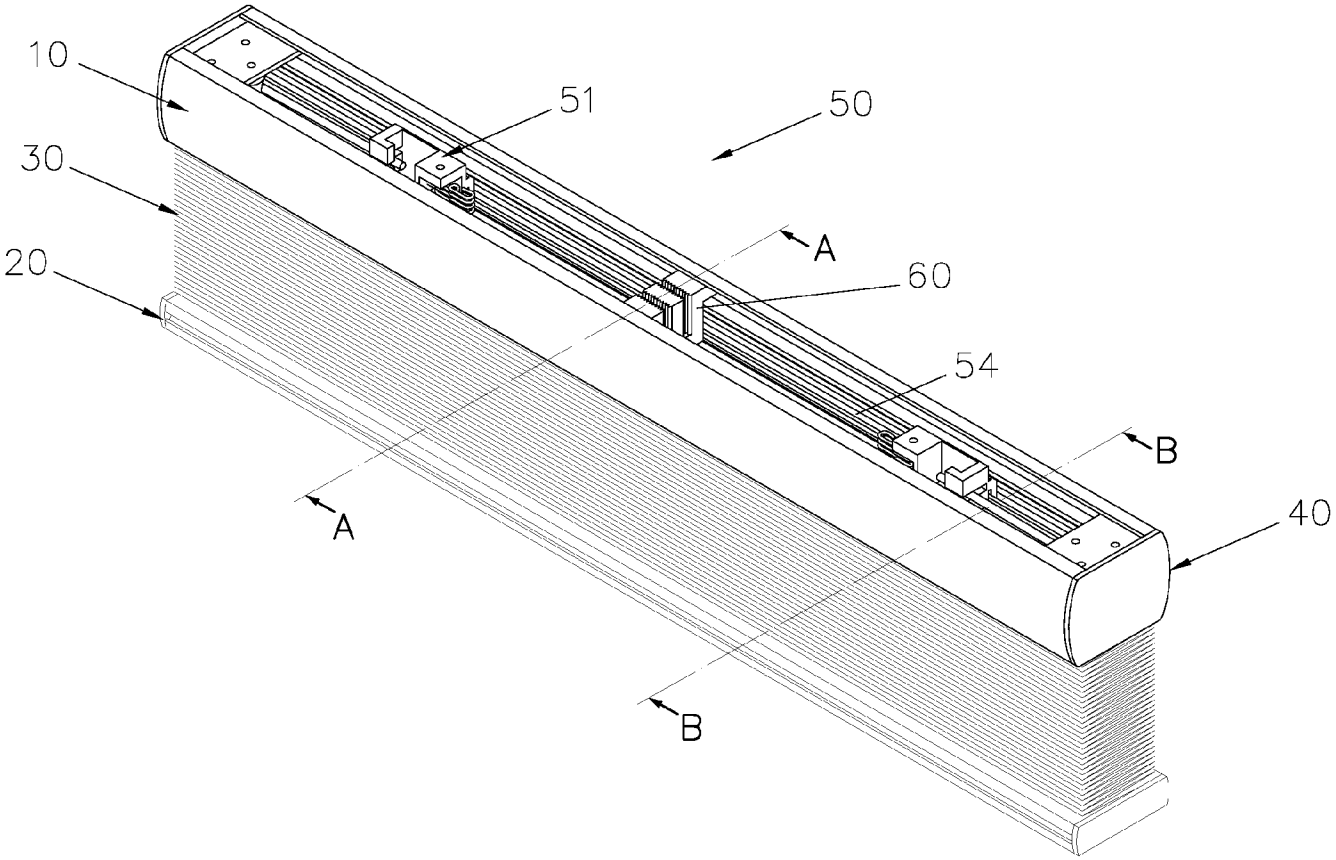
FIG. 1 is a perspective view showing the assembly of a pull rope free curtain structure according to a first embodiment of the present invention.
Figure 2:
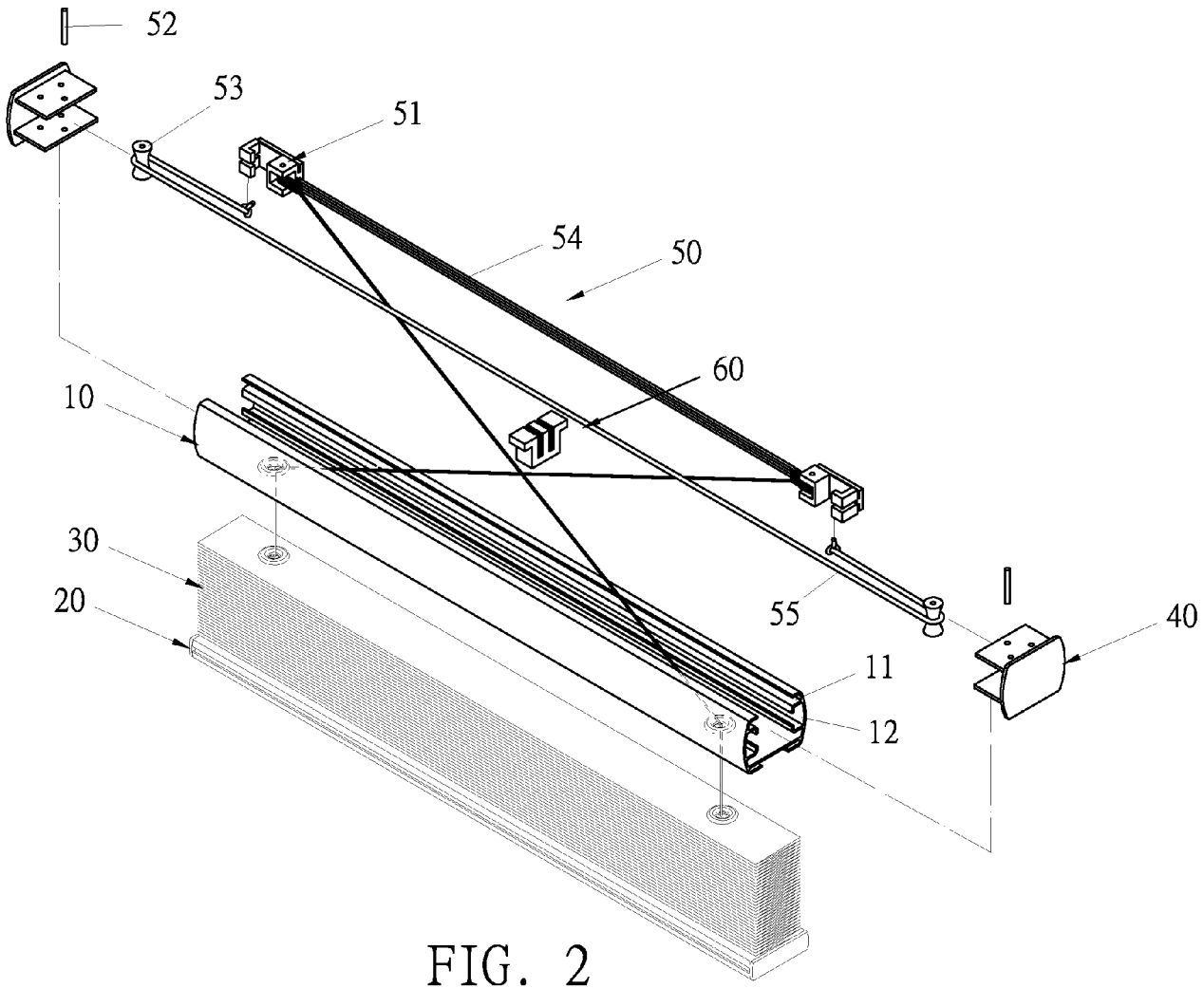
FIG. 2 is a perspective view showing the exploded components of the pull rope free curtain structure according to the first embodiment of the present invention.

With reference to FIGS. 1 to 2, a pull rope free curtain structure according to a first embodiment of the present invention comprises: a first rod 10, a second rod 20, a body 30, two side covers 40, at least one elastic rope assembly 50, and a positioning member 60.

Figure 4:
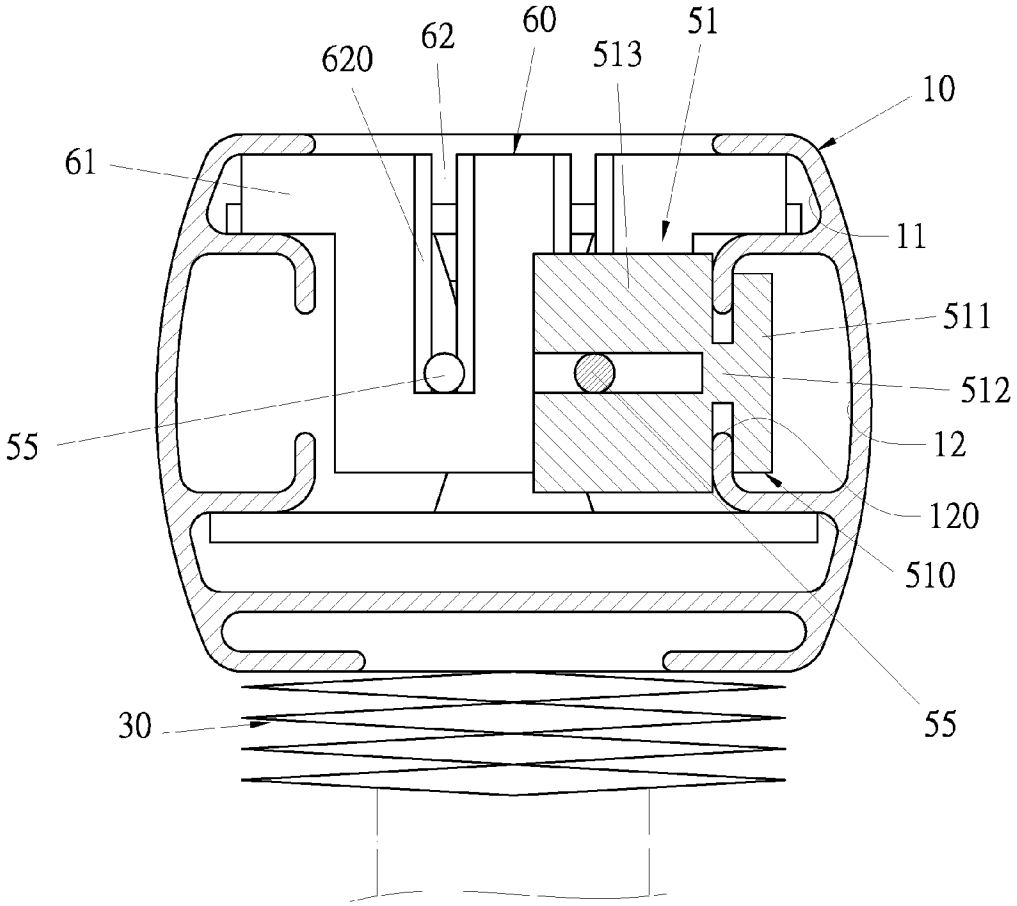
FIG. 4 is a cross sectional view showing the assembly of a part of the pull rope free curtain structure according to the first embodiment of the present invention.

Referring to FIG. 4, the first rod 10 is hollow and includes two upper rails 11 formed on two inner side walls thereof and at least one lower rail 12 parallelly arranged below each upper rail 11, wherein each of the at least one lower rail 12 has an opening 120 defined thereon, i.e., each of the at least one lower rail 12 has a C-shaped cross section. In this embodiment, the first rail 10 includes two lower rails 12 parallelly arranged below two upper rails 11 formed on the two inner side walls thereof. In another embodiment, one lower rail 12 is parallelly arranged below one of the two upper rails 11.

The second rod 20 is parallel to the first rod 10.

The body 30 includes a top end disposed on the first rod 10 and includes a bottom end mounted on the second rod 20.

The two side covers 40 are covered on two ends of the first rod 10.

Each elastic rope assembly 50 includes two driving members 51, two limiting members 52, two bushings 53, a first control rope 54, and a second control rope 55 which is elastic.

Figure 3:
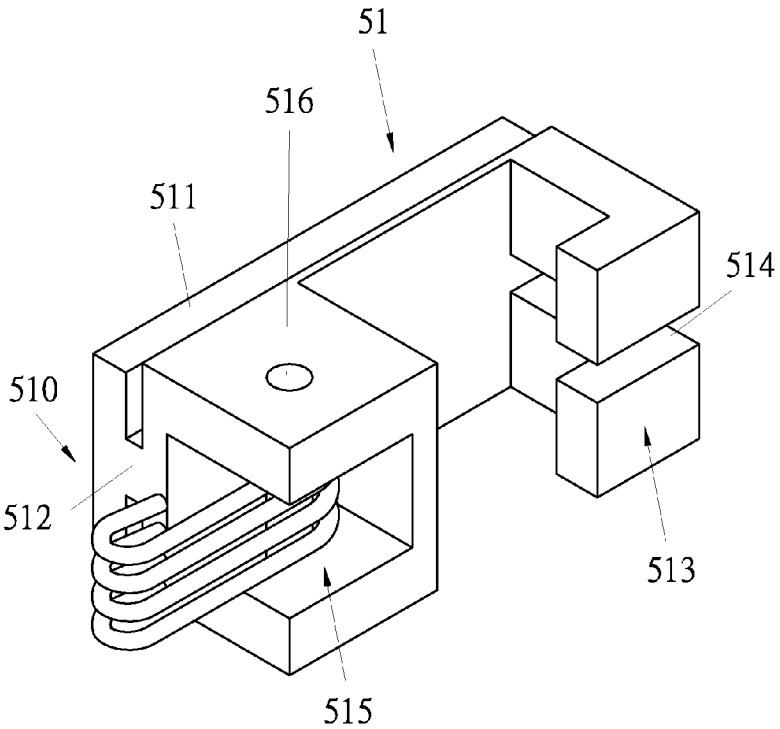
FIG. 3 is a perspective view showing the assembly of a driving member of the pull rope free curtain structure according to the first embodiment of the present invention.

As shown in FIGS. 3 and 4, the two driving members 51 are accommodated in the first rod 10 and are inserted into two ends of each lower rail 12, wherein each driving member 51 has an inverted T-shaped track 510, a retaining portion 513, and a rotatable connecting portion 515. The inverted T-shaped track 510 has an extension 511 and a joining section 512, wherein the extension 511 is accommodated in one of the at least one lower rail 12, the joining section 512 extends out of the opening 120 of the one lower rail 12, the retaining portion 513 and the rotatable connecting portion 515 are formed on two ends of each driving member 51, a slot 514 is defined on a middle section of the retaining portion 513, and the rotatable connecting portion 515 has at least one coupling shaft 516.

Each limiting member 52 has a bushing 53 fitted thereon and is fixed on each side cover 40.

The first control rope 54 is winded between two coupling shafts 516 of two rotatable connecting portions 515 of the two driving members 51, and two ends of the first control rope 54 are intersected and inserted through two inner bottom holes of the first rod 10 and then are fixed on two ends of the second rod 20 via through the body 30.

Two ends of the second control rope 55 are winded around the two bushings 53 and are tied in two slots 514 of the two driving members 51.

Figure 5:
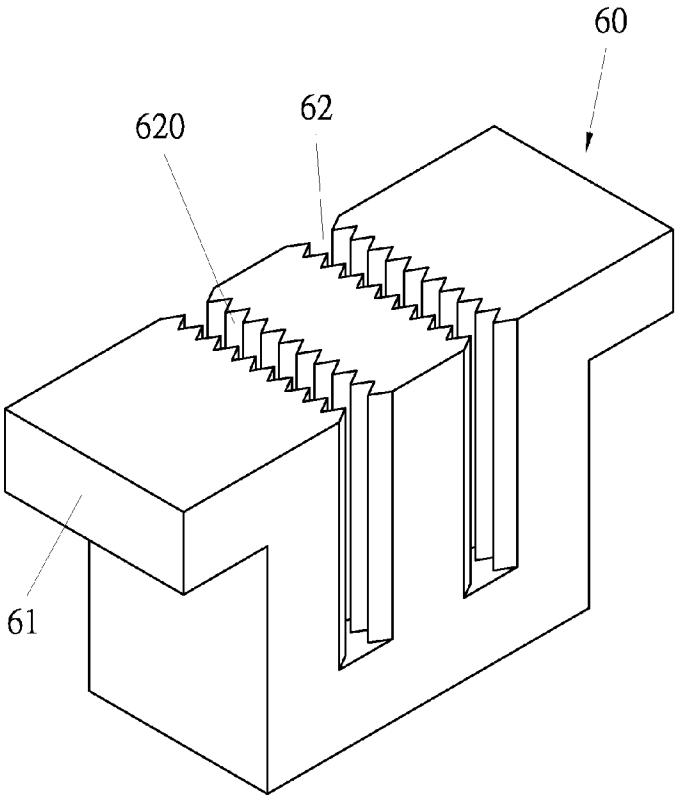
FIG. 5 is a perspective view showing the assembly of a positioning member of the pull rope free curtain structure according to the first embodiment of the present invention.
Figure 6:
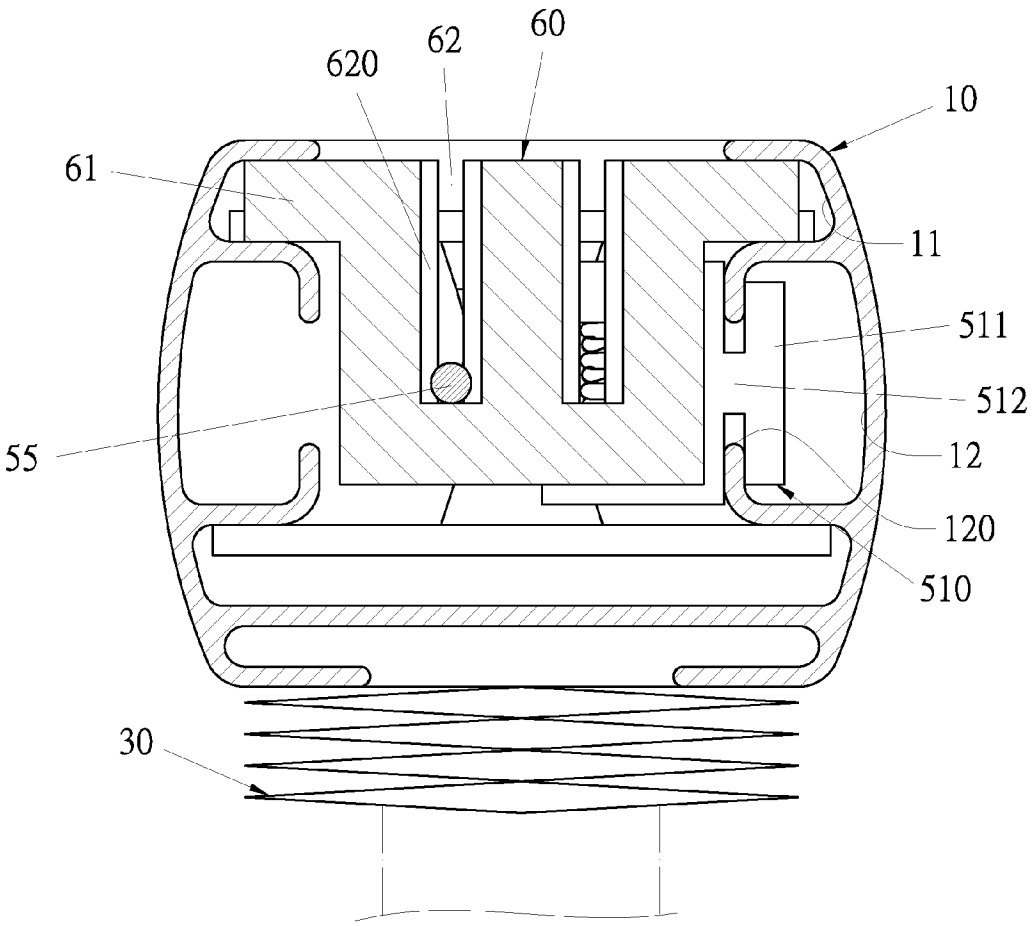
FIG. 6 is another cross sectional view showing the assembly of a part of the pull rope free curtain structure according to the first embodiment of the present invention.
Figure 7:
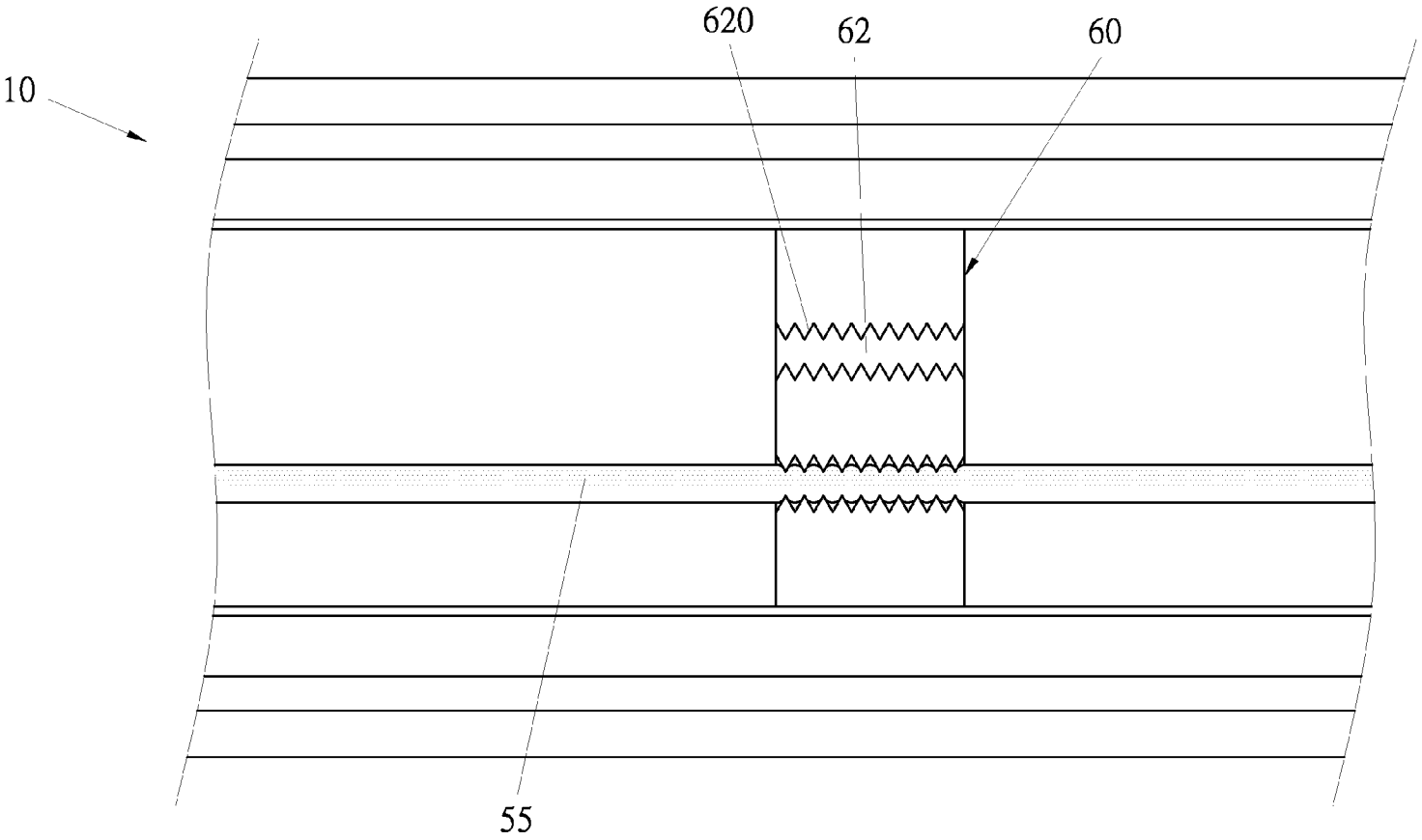
FIG. 7 is a cross sectional view showing the positioning member retaining with a second control rope of the pull rope free curtain structure according to the first embodiment of the present invention.

As illustrated in FIGS. 5 to 7, the positioning member 60 includes two wings 61 extending outwardly from two sides of a top end thereof, wherein the two wings 61 are fitted in the two upper rails 11 of the first rod 10 (i.e., on a central position of the first rod 10), and the positioning member 60 also includes at least one recess 62 defined thereon parallel to the first rod 10. In this embodiment, two recesses 62 are defined on the positioning member 60, and each recess 62 has plural teeth 620 formed around two sides of a top end thereof for retaining the positioning member 60 on a central position of the second control rope 55 of each elastic rope assembly 50.

Figure 8:
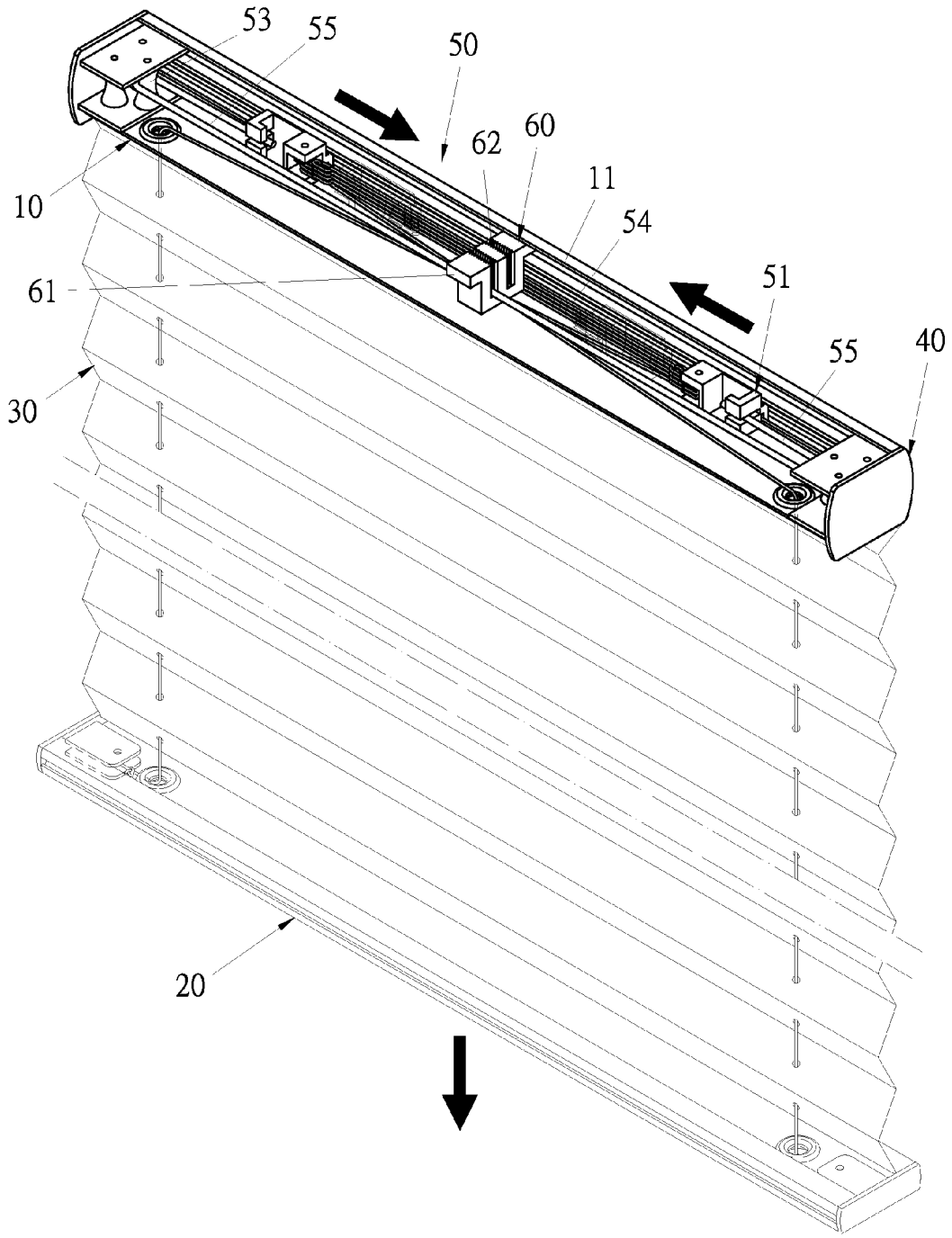
FIG. 8 is a perspective view showing the operation of the pull rope free curtain structure according to the first embodiment of the present invention.

In use, as shown in FIG. 8, the second rod 20 is pulled by a user to drive the body 30 to move downwardly, such that the first control rope 54 is pulled so that the two driving members 51 move to each other and pull the second control rope 55, wherein when the body 30 is pulled toward a desired position and the user releases the second rod 20, the first control rope 54 pulls the body 30 and the second rod 20 to produce a gravity for balancing an elasticity of the second control rope 55, thus positioning the body 30 and adjusting a height of the body 30. In contrast, after pulling the body 30, the gravity for balancing the elasticity of the second control rope 55 is stopped, thus adjusting the body 30 at the desired height again. Preferably, the central position of the second control rope 55 of each elastic rope assembly 50 is fixed by ways of the positioning member 60 to maintain a pull force on the two ends of the second control rope 55 and a relative position between the two driving members 51, hence operations of two sides of the positioning member 60 are consistent to balance the body 30. In addition, the two driving members 51 is guided by each lower rail 12 to avoid a removal of the two driving members 51 from the first rod 10 or an obstruction of the two driving members 51 in the first rod 10.

Figure 9:
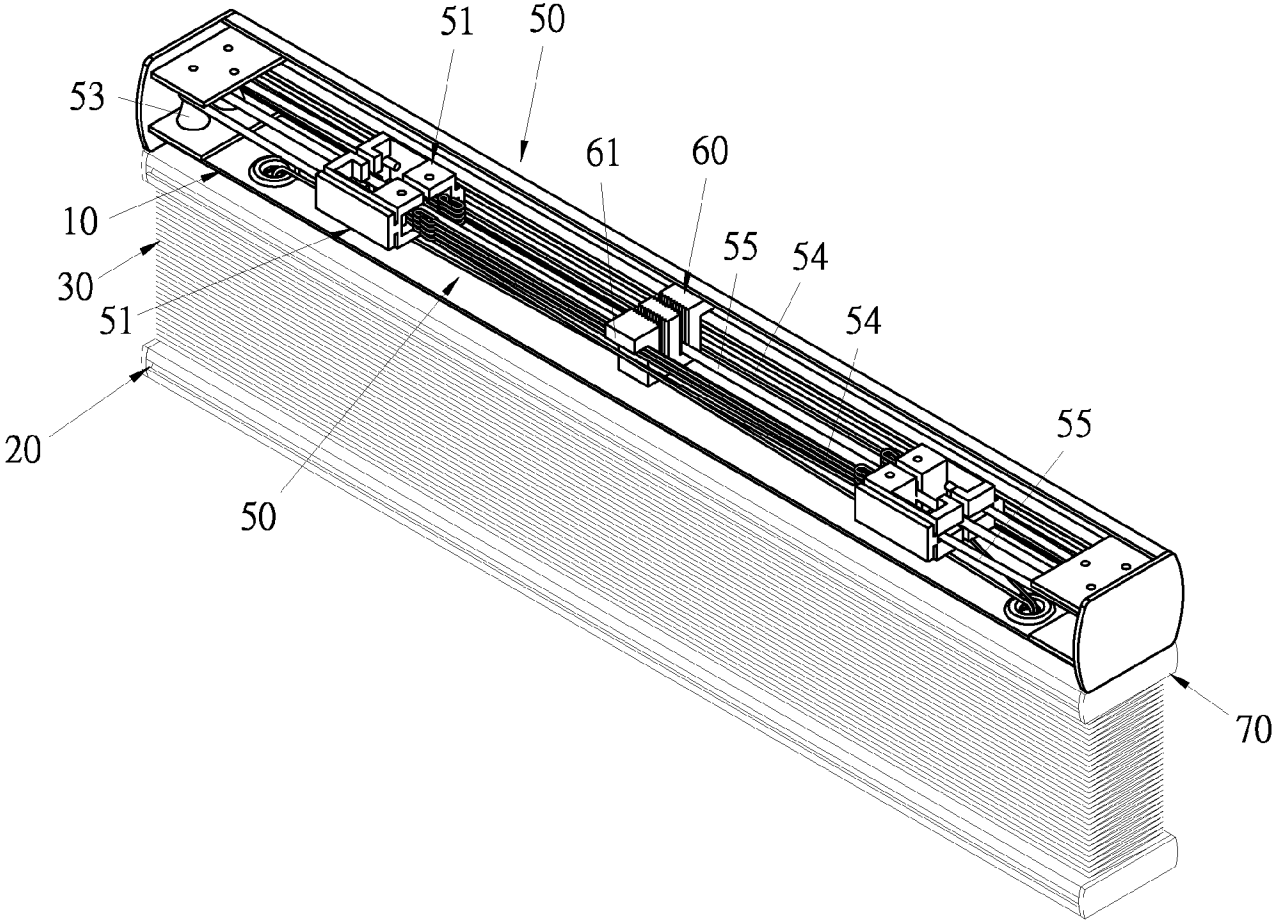
FIG. 9 is a perspective view showing the assembly of a pull rope free curtain structure according to a second embodiment of the present invention.
Figure 10:
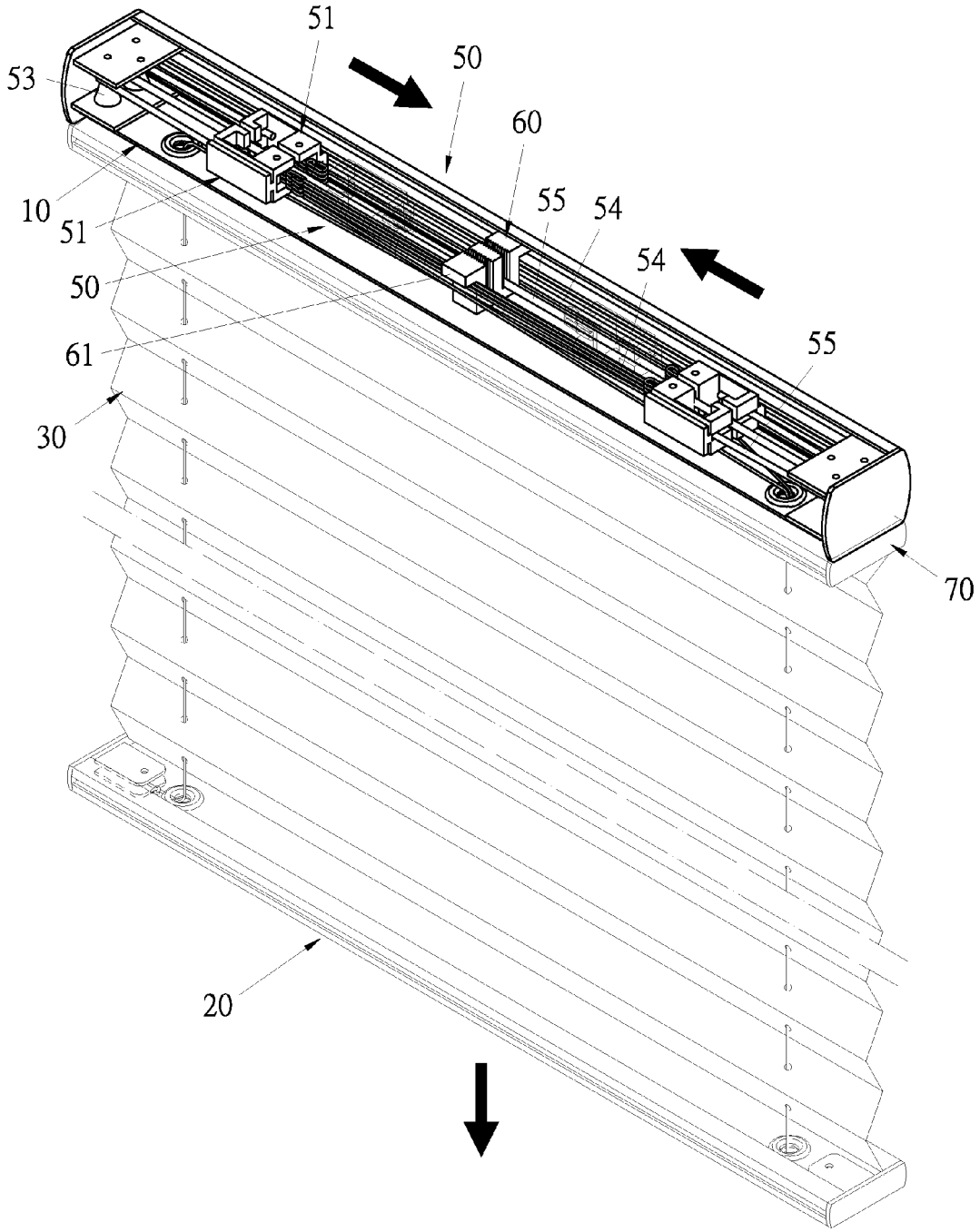
FIG. 10 is a perspective view showing the operation of the pull rope free curtain structure according to the second embodiment of the present invention.
Figure 11:
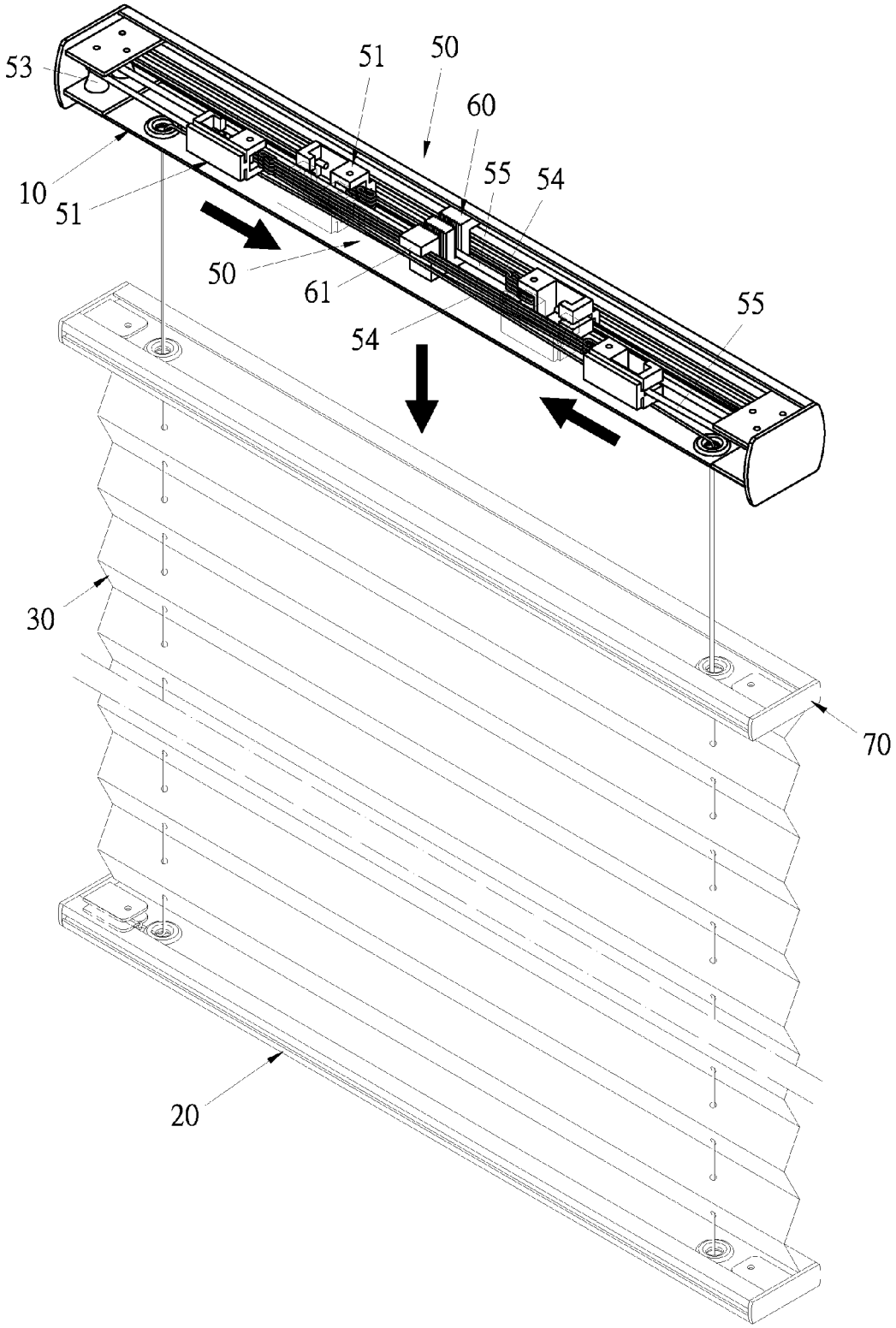
FIG. 11 is another perspective view showing the operation of the pull rope free curtain structure according to the second embodiment of the present invention.
Figure 12:
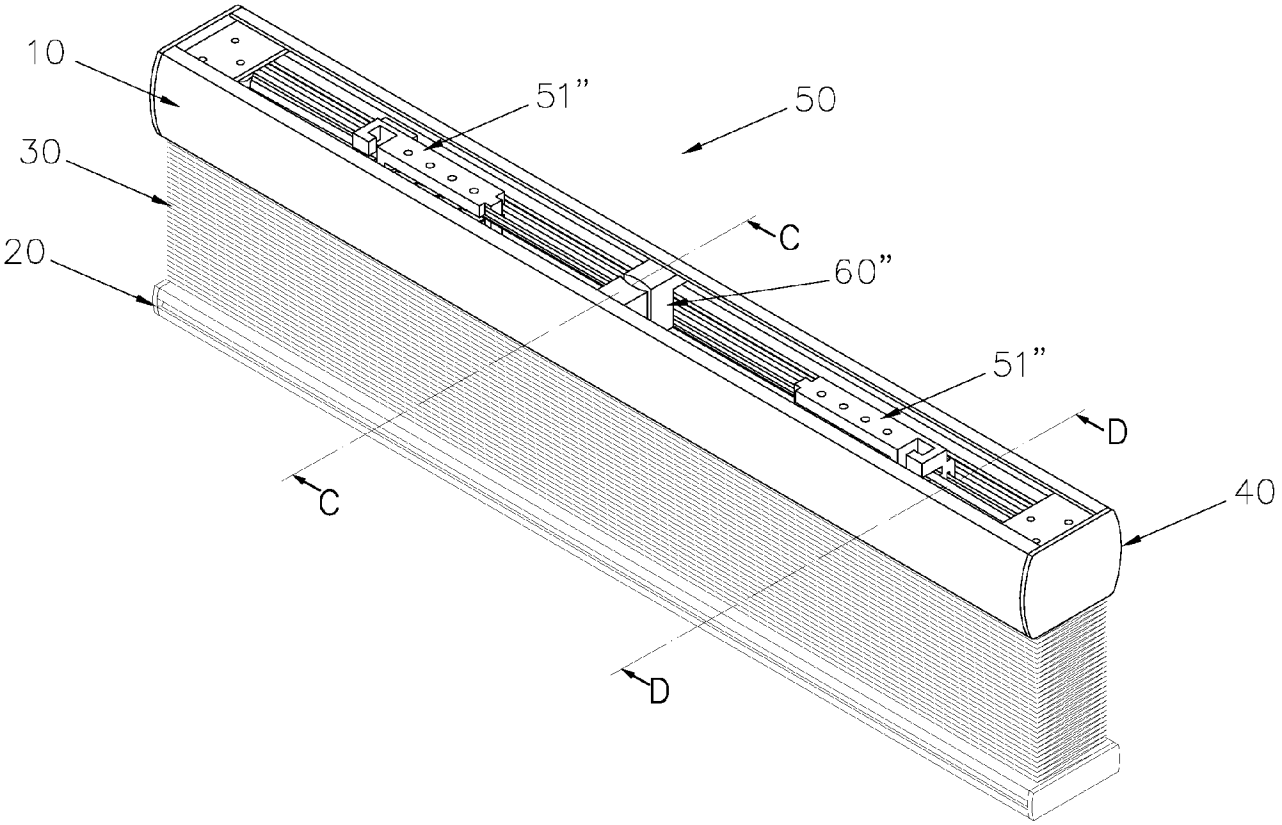
FIG. 12 is a perspective view showing the assembly of a pull rope free curtain structure according to a third embodiment of the present invention.
Figure 13:
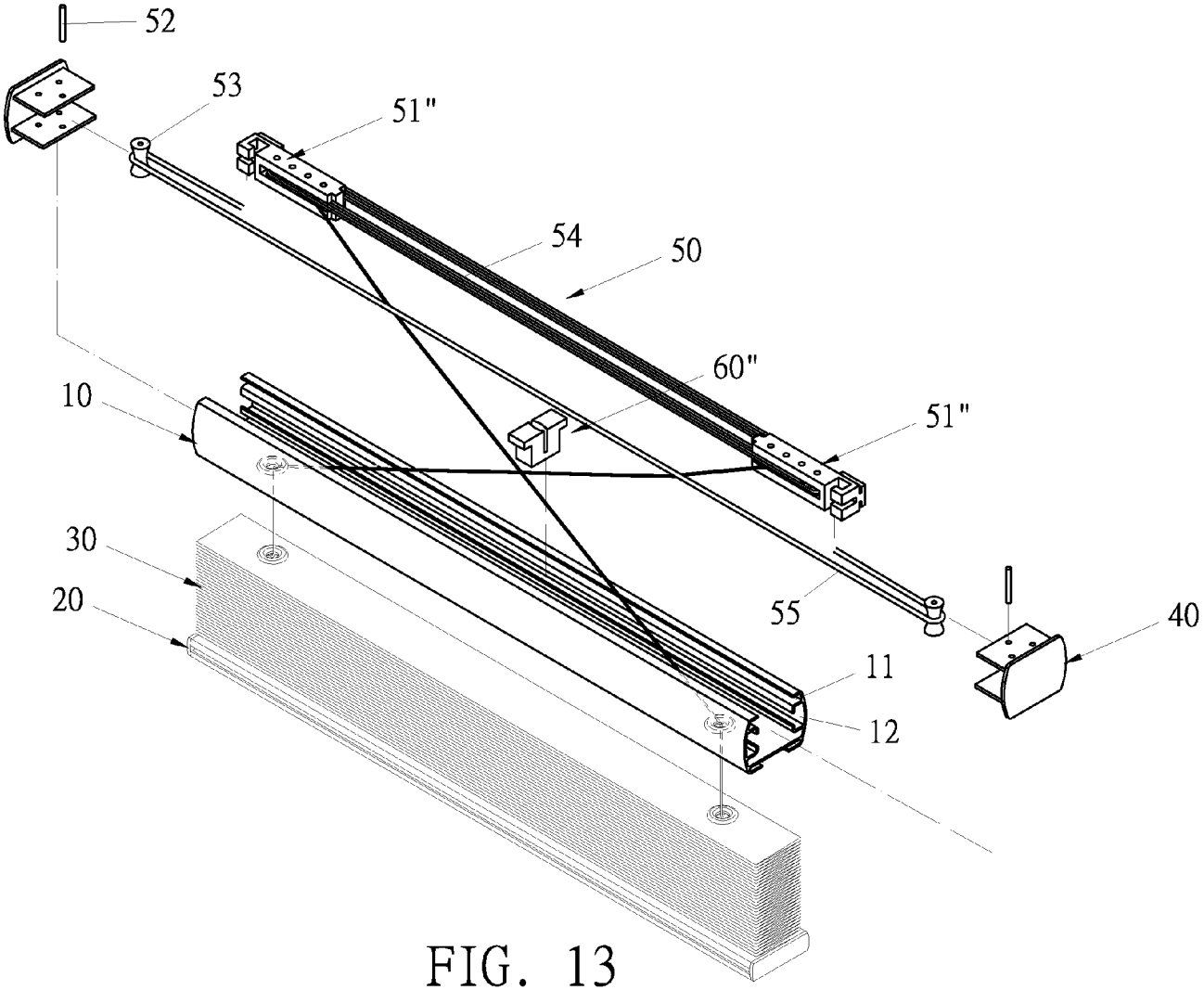
FIG. 13 is a perspective view showing the exploded components of the pull rope free curtain structure according to the third embodiment of the present invention.

With reference to FIGS. 9 to 11, a difference of a pull rope free curtain structure of a second embodiment from that of the first embodiment comprises: two elastic rope assemblies 50, a middle plate 70 defined between the first rod 10 and the body 30, wherein the middle plate 70 is disposed on a top end of the body 30, the second rod 20 is mounted on a bottom end of the body 30, and two central portions of two second control ropes 55 of the two elastic rope assemblies 50 are retained in the two recesses 62 of the positioning member 60, wherein two ends of a first control rope 54 of one of the two elastic rope assemblies 50 are mounted on the two ends of the second rod 20, and two ends of a first control rope 54 of the other of the two elastic rope assemblies 50 are fixed on two ends of the middle plate 70.

Referring to FIG. 10, the second rod 20 is pulled to drive the one of the two elastic rope assemblies 50 to move, thus adjusting the height of the body 30 of the second embodiment as that of the first embodiment. As shown in FIG. 11, the middle plate 70 is pulled to drive the other of the two elastic rope assemblies 50, such that a force between the first control rope 54 of the other of the two elastic rope assemblies 50 and one of the two second control ropes 55 is balanced, thus positioning the middle plate 70 and moving the body 30 toward the desired position. Preferably, the two central portions of the two second control ropes 55 of the two elastic rope assemblies 50 are fixed by the positioning member 60, thus enhancing operational stability of the middle plate 70 and the second rod 20.

Figure 14:
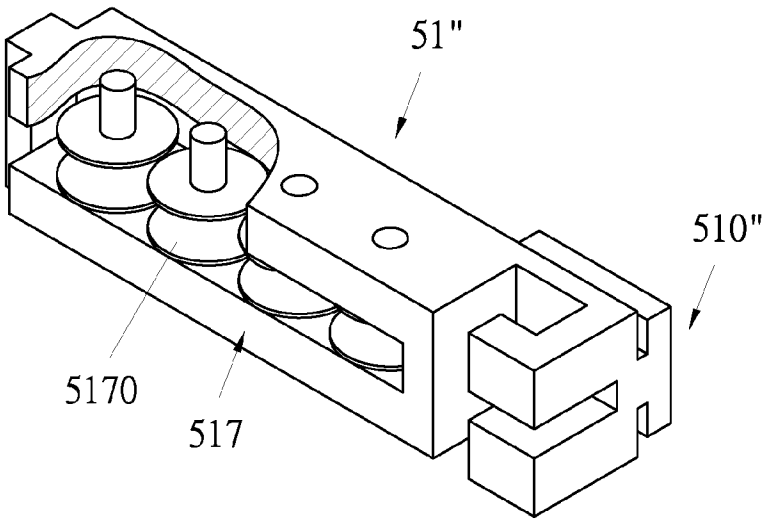
FIG. 14 is a perspective view showing the assembly of a driving member of the pull rope free curtain structure according to the third embodiment of the present invention.
Figure 16:
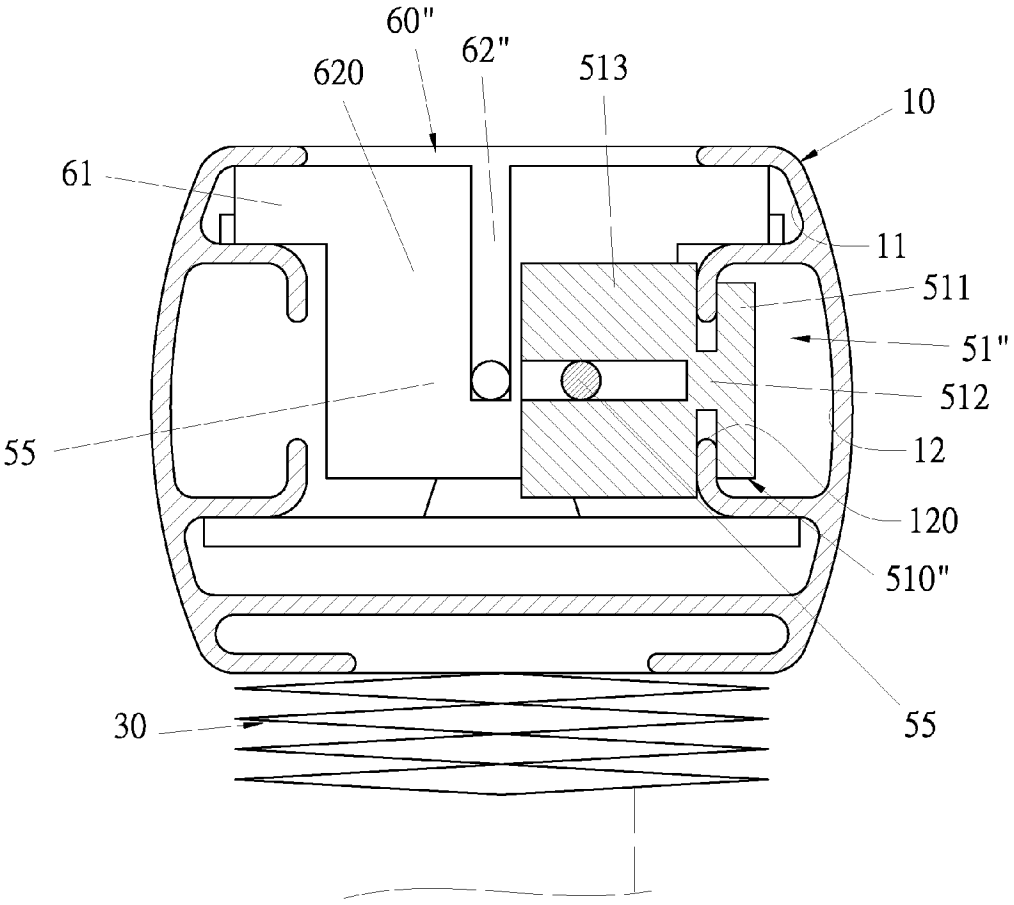
FIG. 16 is a cross sectional view showing the assembly of a part of the pull rope free curtain structure according to the third embodiment of the present invention.

As shown in FIGS. 12 to 16, a difference of a pull rope free curtain structure of a third embodiment from that of the first embodiment comprises: two pulley sets 517 (as illustrated in FIG. 14) for replacing the two coupling shafts 516 of the two rotatable connecting portions 515 of the two driving members 51, wherein each pulley set 517 has a plurality of rollers 5170 arranged parallel to an inverted T-shaped track 510" of each driving member 51", the first control rope 54 is winded between the two pulley sets 517 of the two driving members 51", such that the first control rope 54 pulls the two driving members 51" smoothly. Furthermore, the plurality of rollers 5170 facilitates a smooth pulling of the two driving members 51". For example, as shown in FIG. 14, each pulley set 517 of each driving member 51" has four rollers 5170 to facilitate the smooth pulling of the each driving member 51".

Figure 15:
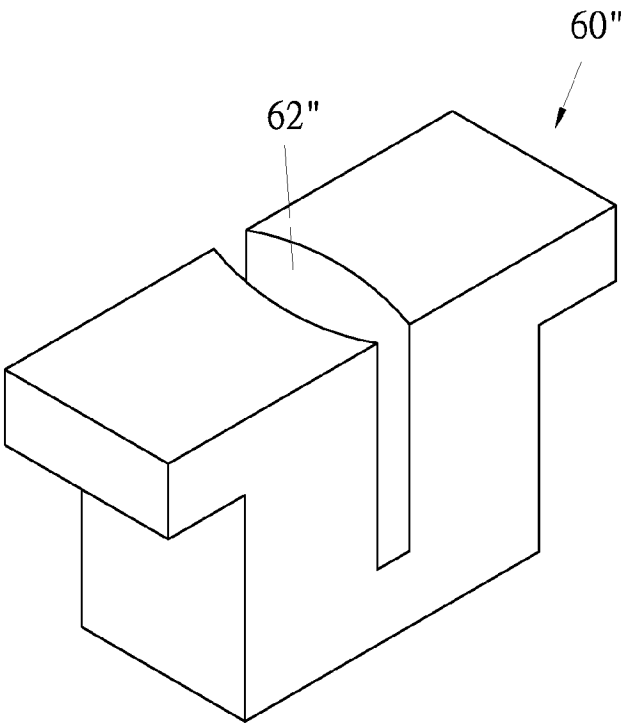
FIG. 15 is a perspective view showing the assembly of a positioning member of the pull rope free curtain structure according to the third embodiment of the present invention.

With reference to FIG. 15, a positioning member 60" includes a recess 62" for retaining the two second control ropes 55. It is to be noted that a matching manner of the two driving members 51" and the positioning member 60" is not limited. In other words, the two driving members 51 of FIG. 3 and the two driving members 51" of FIG. 14 or the positioning member 60 of FIG. 5 and the positioning member 60" of FIG. 15 are changeable. For instance, the two driving members 51 of FIG. 3 cooperate with the positioning member 60" of FIG. 15.

Figure 17:
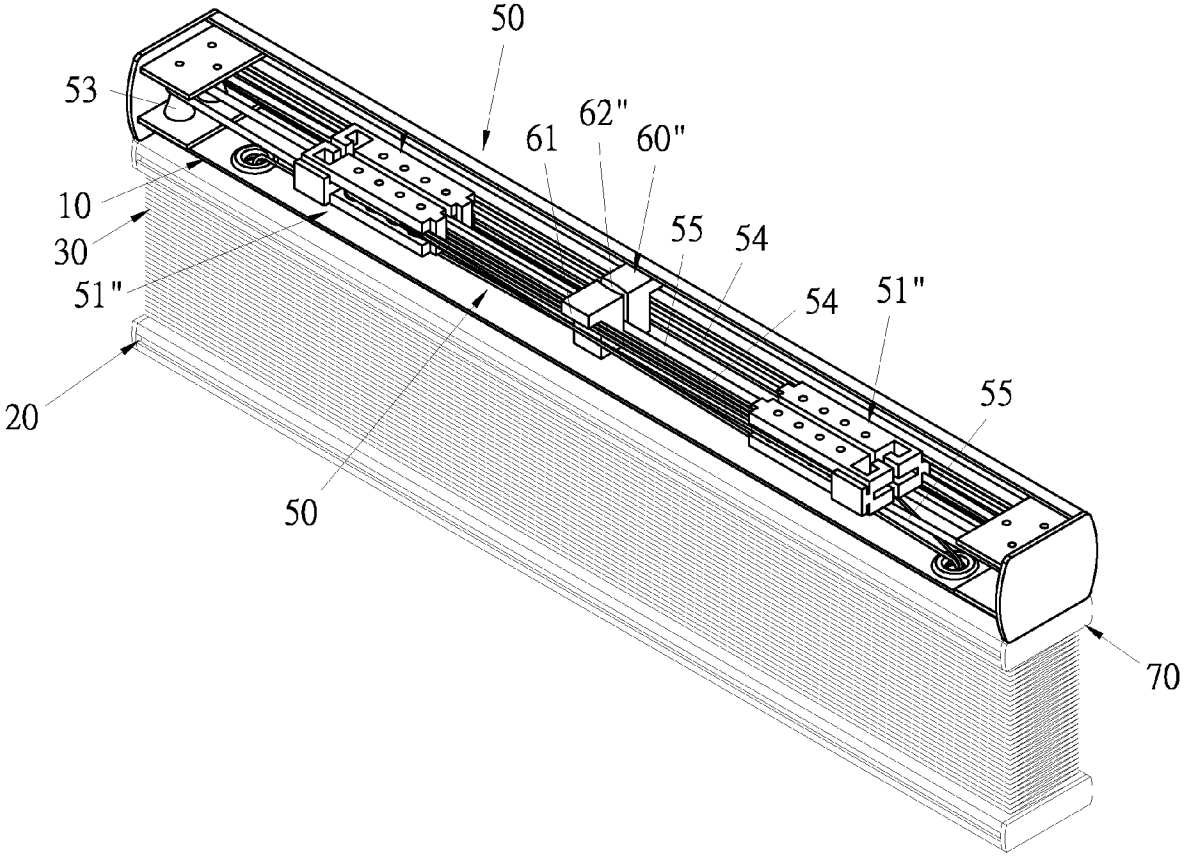
FIG. 17 is a perspective view showing another driving member and another positioning member being applicable for the pull rope free curtain structure of the second embodiment of the present invention.

Referring further to FIG. 17, the two driving members 51" of FIG. 14 and the positioning member 60" of FIG. 15 are applicable for the pull rope free curtain structure of the third embodiment, wherein the two second control ropes 55 of the two elastic rope assemblies 50 are retained in the recess 62" of the positioning member 60". Moreover, the two driving members 51" of FIG. 14 replace the two driving members 50 of the second embodiment, as shown in FIG. 3, and the two second control ropes 55 of the two elastic rope assemblies 50 are winded between the two driving members 51". Likewise, four driving members 51" are configured to replace the two driving members 51 of the second embodiment.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A pull rope free curtain structure comprising:

a first rod having two ends, wherein said rod is hollow;

a second rod having two ends and being parallel to the first rod;

a body including a bottom end mounted on the second rod;

at least one elastic rope assembly, each including:

two driving members, each being slidably disposed in the first rod;

a first control rope which is wound about the coupling shaft of each of said two driving members to form a multiplicity of loops, and two ends of the first control rope are intersected and inserted through two inner bottom holes of the first rod and then are fixed on two ends of the second rod through the body;

a second control rope being elastic, having two ends and being wound about the two ends of the first rod, each of said two ends is fixed on one of the two driving members;

a positioning member which is attached to a central point on an upper rail of the first rod and retained on a central point of the second control rope.

2. The pull rope free curtain structure as claimed in claim 1, wherein the first rod includes two upper rails formed on two inner side walls thereof to insert through the positioning member.

3. The pull rope free curtain structure as claimed in claim 2, wherein the positioning member includes two wings extending outwardly from two sides of a top end thereof, wherein the two wings are fitted in the two upper rails of the first rod.

4. The pull rope free curtain structure as claimed in claim 1, wherein the positioning member also includes at least one recess defined thereon to retain the second control rope.

5. The pull rope free curtain structure as claimed in claim 4, wherein each recess has plural teeth formed around two sides of a top end thereof.

6. The pull rope free curtain structure as claimed in claim 1, wherein the first rod also includes at least one lower rail parallelly arranged below each upper rail, and each of the at least one lower rail has an opening defined thereon, wherein the two driving members are inserted into two ends of each lower rail, each driving member has an inverted T-shaped track, the inverted T-shaped track has an extension and a joining section, wherein the extension is accommodated in one of the at least one lower rail, and the joining section extends out of the opening.

7. The pull rope free curtain structure as claimed in claim 6, wherein each driving member also has a retaining portion and a rotatable connecting portion which are formed on two ends of each driving member, the retaining portion is connected with one of the two ends of the second control rope, and the rotatable connecting portion is used to wind the first control rope.

8. The pull rope free curtain structure as claimed in claim 7, wherein the rotatable connecting portion has at least one coupling shaft, and the first control rope is winded between the at least one coupling shaft.

9. The pull rope free curtain structure as claimed in claim 7, wherein the rotatable connecting portion has at least one pulley set, and the first control rope is winded between the at least one pulley set.

10. The pull rope free curtain structure as claimed in claim 9, wherein each pulley set has at least one roller.

11. The pull rope free curtain structure as claimed in claim 9, wherein each pulley set has four rollers arranged parallel to the inverted T-shaped track.

12. The pull rope free curtain structure as claimed in claim 1, wherein the body includes a top end disposed on the first rod.

13. The pull rope free curtain structure as claimed in claim 6 further comprising a middle plate defined between the first rod and the body, wherein the middle plate is disposed on the top end of the body, the second rod is mounted on the bottom end of the body, and the first rail includes two lower rails parallelly arranged below the two upper rails formed on two inner side walls thereof, two elastic rope assemblies are provided and include the two driving members, two first control ropes, and two second control ropes; wherein two extensions of the two driving members are accommodated in the two lower rails, and wherein two ends of a first control rope of one of the two elastic rope assemblies are mounted on the two ends of the second rod, two ends of a first control rope of the other of the two elastic rope assemblies are fixed on two ends of the middle plate, and two central portions of the two second control ropes are fixed by the positioning member.

14. The pull rope free curtain structure as claimed in claim 13, wherein the positioning member includes two recesses, and the two second control ropes are retained in the two recesses of the positioning member.

15. The pull rope free curtain structure as claimed in claim 14, wherein each recess has plural teeth formed around two sides of a top end thereof.

16. The pull rope free curtain structure as claimed in claim 1 further comprising two side covers covered on the two ends of the first rod.

17. The pull rope free curtain structure as claimed in claim 16, wherein each elastic rope assembly further includes two limiting members and two bushings, and the two bushings are fitted on the two limiting members, the two limiting members are fixed on the two side covers, the two ends of the second control rope are winded around the two bushings and are tied in one of the two driving members.

* * * * *